US006715281B2

(12) United States Patent
Zhu

(10) Patent No.: US 6,715,281 B2
(45) Date of Patent: Apr. 6, 2004

(54) OXYGEN STORAGE MANAGEMENT AND CONTROL WITH THREE-WAY CATALYST

(75) Inventor: Dannie Zhu, Lake Orion, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 10/232,784

(22) Filed: Aug. 28, 2002

(65) Prior Publication Data

US 2004/0040282 A1 Mar. 4, 2004

(51) Int. Cl.[7] ..... F01N 3/00
(52) U.S. Cl. ..... 60/276; 60/274; 60/285
(58) Field of Search ..... 60/274, 276, 277, 60/285; 73/23.31, 23.32, 118.1

(56) References Cited

U.S. PATENT DOCUMENTS

| | | | | |
|---|---|---|---|---|
| 5,214,915 | A | * 6/1993 | Schneider et al. | 60/276 |
| 5,267,472 | A | * 12/1993 | Schneider et al. | 60/277 |
| 5,293,740 | A | * 3/1994 | Heppner et al. | 60/285 |
| 5,826,426 | A | 10/1998 | Weber et al. | |
| 5,842,340 | A | * 12/1998 | Bush et al. | 60/285 |
| 5,847,271 | A | 12/1998 | Poublon et al. | |
| 6,167,754 | B1 | 1/2001 | Koenders | |
| 6,289,673 | B1 | * 9/2001 | Tayama et al. | 60/285 |
| 6,405,527 | B2 | 6/2002 | Suzuki et al. | |
| 6,453,662 | B1 | * 9/2002 | Lewis et al. | 60/274 |
| 6,499,290 | B1 | * 12/2002 | Nakamura et al. | 60/274 |

OTHER PUBLICATIONS

Noriyuki Kishi, Shinichi Kikuchi, Norio Suzuki and Tadayoshi Hayashi; Technology for Reducing Exhaust Gas Emissions in Zero Level Emission Vehicles (ZLEV); International Congress and Exposition, Detroit, Michigan—Mar. 1–4, 1999; 11 Pages.

* cited by examiner

*Primary Examiner*—Thomas Denion
*Assistant Examiner*—Tu M. Nguyen
(74) *Attorney, Agent, or Firm*—Edwin W. Bacon, Jr.

(57) ABSTRACT

A method and system for controlling exhaust emissions from an engine of a motor vehicle includes sensing oxygen levels upstream and downstream of a catalytic converter, predicting an instantaneous oxygen storage amount in the catalytic converter, determining a maximum oxygen storage capacity, selecting a target percentage of the maximum oxygen storage amount, and controlling the motor vehicle engine performance to a state where the oxygen storage amount is approximately the target percentage of the maximum oxygen storage amount. The instantaneous oxygen storage amount is determined from an oxygen storage mass flow rate, which is determined from a converter-in mass flow rate, converter-out mass flow rate, and a predicted oxygen consumption mass flow rate. The converter-in and converter-out mass flow rates are calculated from an upstream and downstream oxygen mass fraction, respectively, based on the sensed upstream and downstream oxygen levels, respectively.

19 Claims, 2 Drawing Sheets

OXYGEN STORAGE MANAGEMENT AND CONTROL WITH THREE-WAY CATALYST

FIELD OF THE INVENTION

The present invention relates generally to vehicle engine control, and more particularly, to a catalytic converter control system for oxygen storage management and control.

BACKGROUND OF THE INVENTION

Increasingly stringent federal and state motor vehicle emissions standards require that specific emissions-related systems on a motor vehicle be controlled and optimized. These systems must be functioning as intended over the life of the vehicle, and if the systems have deteriorated or lose their functionality, the vehicle operator must be informed and the system repaired. For example, a catalytic converter of a motor vehicle is monitored because of its ability to reduce undesirable emissions in exhaust gases from the engine of the motor vehicle.

The performance of the catalytic converter depends upon the chemical compositions of the exhaust gases from the engine of the motor vehicle. Maintaining the feed-gas concentration to the catalytic converter close to stoichiometry maximizes catalytic converter efficiency. The oxygen storage capability of the catalytic converter determines the functional performance of the converter, which may also deteriorate over time due to factors such as engine misfire, a faulty oxygen sensor, poisoning or prolonged high-temperature operation. Such deteriorzatioin results in diminished capability to store the oxygen available in the exhaust gases. Active management and control of the amount of oxygen stored in the catalyst during motor vehicle operation helps lower pollutants from motor vehicle emissions.

Three-way catalytic converters are designed to have oxygen storage capability to improve their conversion efficiency. Oxygen storage/release is carried out by the precious-metal-assisted transition between $Ce^{3+}$ and $Ce^{4+}$ of Ceria compound added to the washcoat of the catalyst. The major storage/release reactions are shown below.

$$Ce_2O_3 + 0.5O_2 \xrightarrow{Pt/Pd/Rh} 2CeO_2 \quad (1)\ \text{(Storage)}$$

$$Ce_2O_3 + NO \xrightarrow{Pt/Pd/Rh} 2CeO_2 + 0.5N_2 \quad (2)$$

$$2CeO_3 + CO \xrightarrow{Pt/Pd/Rh} Ce_2O_3 + CO_2 \quad (3)\ \text{(Release)}$$

$$2CeO_3 + H_2 \xrightarrow{Pt/Pd/Rh} Ce_2O_3 + H_2O \quad (4)$$

Current engines have an on-board control system that applies one or more oxygen sensor outputs to control fuel/air flow rates. Emission control is accomplished by increasing catalyst loading. This results in adding more precious metal particles, thereby increasing the overall volume and cost of the catalytic converter.

A major drawback of current engine systems are that no known current engines employ active management of oxygen storage amount or oxygen storage capacity. Knowing the instantaneous oxygen storage amount is key to emission control. A further drawback is that catalysts can be saturated when too much oxygen is coming high-temperature exposure and poisoning due to the decreased surface area of the Ceria and the precious metal particles.

Accordingly, active oxygen storage management and control would improve emission control. An engine capable of predicting instantaneous oxygen storage amount is desired to overcome emission breakthroughs, increase catalytic converter efficiency, and generally reduce the overall size and cost of the catalytic converter.

SUMMARY OF THE INVENTION

The active oxygen storage management and control method and system according to the invention include sensing oxygen levels upstream and downstream of a catalytic converter for a fuel-injected engine of a motor vehicle. An engine control system predicts an oxygen consumption mass flow rate, and then determines an oxygen storage mass flow rate based on the sensed upstream and downstream oxygen levels and the predicted oxygen consumption mass flow rate. The oxygen storage mass flow rate is used to determine an instantaneous oxygen storage amount.

To determine the oxygen storage mass flow rate, the upstream and downstream oxygen levels are sensed and used to calculate upstream and downstream oxygen mass fractions, which are then used to determine a converter-in oxygen mass flow rate and a converter-out oxygen mass flow rate. Thus, the oxygen mass flow rate is preferably determined from converter-in mass flow rate, converter-out mass flow rate, and the predicted oxygen consumption mass flow rate.

Further, the upstream and downstream oxygen levels are preferably used to determine an upstream and downstream oxygen flow rate by determining an upstream and downstream lambda. In this manner, the determination of the upstream and downstream oxygen mass fractions are achieved by using the upstream or downstream lambda, respectively, as well as a set of reaction constants and a reaction fraction.

The method according to the invention is used to control exhaust emissions from a motor vehicle by predicting an instantaneous oxygen storage amount in the catalytic converter, determining a maximum oxygen storage capacity, and selecting a target percentage of the maximum oxygen storage amount. The motor vehicle engine performance is controlled so that the instantaneous oxygen storage amount is approximately the target percentage of the maximum oxygen storage amount. To accomplish this control, the instantaneous oxygen storage amount and the maximum oxygen storage amount are calculated as discussed above.

An engine control system according to the invention disposes oxygen sensors upstream and downstream from a catalytic converter. The engine control system monitors engine operating parameters including an output signal on the upstream and downstream oxygen sensors, determines an instantaneous oxygen storage amount based on the monitored sensor output signals, and controls engine operation to maintain the determined instantaneous oxygen storage amount in a predicted oxygen storage capacity. The engine control system monitors a plurality of engine control terms including a target instantaneous oxygen storage amount selected within a range from zero oxygen storage capacity to about a predicted maximum oxygen storage capacity.

The engine control system controls engine operation to maintain the instantaneous oxygen storage amount at approximately the target instantaneous oxygen storage amount. A plurality of fuel injectors receive a control signal from the engine control system to supply fuel to the engine at a rate where the instantaneous oxygen storage amount is approximately the target instantaneous oxygen storage amount.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
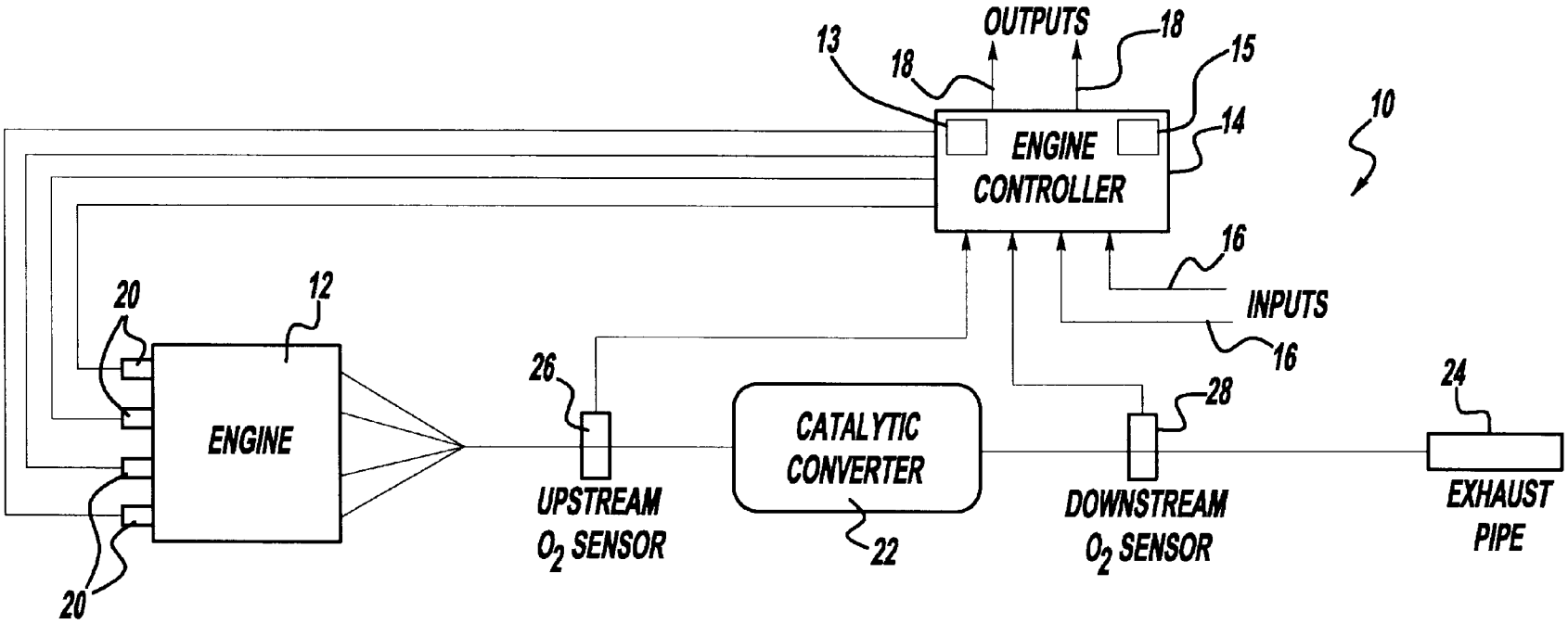
FIG. 1 is a schematic diagram of an emission control system according to the present invention for catalytic converter control.

Referring to FIG. 1, an emission control system 10 for a motor vehicle (not shown) is illustrated. The emission control system 10 includes an engine 12 and an engine controller 14 in communication with the engine 12. The engine controller 14 includes a microprocessing unit 13, memory 15, inputs 16, outputs 18, communication lines and other hardware and software (not shown but known in the art) necessary to control the engine 12 and related tasks. The engine controller 14 may control tasks such as maintaining a fuel-to-air ratio, spark timing, exhaust-gas recirculation and on-board diagnostics. The emission control system 10 may also include other sensors, transducers or the like that are in communication with the engine controller 14 through the inputs 16 and outputs 18 to further carry out a method according to the present invention as described below.

The emission control system 10 also includes at least one fuel injector 20, and preferably a plurality of fuel injectors 20, which receive a signal from the engine controller 14 to precisely meter an amount of fuel to the engine 12. As a result of the combustion process that takes place in the engine 12, exhaust gasses are created and passed out of the engine 12. Constituents of the exhaust gas include hydrocarbons, carbon monoxide and oxides of nitrogen, which are generally believed to have a potentially detrimental effect on air quality.

The emission control system 10 includes a catalytic converter 22 for receiving the exhaust gas from the engine 12. The catalytic converter 22 contains material that serves as a catalyst to reduce or oxidize the components of the exhaust gas into harmless gasses. The emission control system 10 includes an exhaust pipe 24 connected to the catalytic converter 22 and to the atmosphere.

The emission control system 10 further includes an upstream oxygen sensor 26 and downstream oxygen sensor 28, each of which measure the level of oxygen in the exhaust gas. The upstream oxygen sensor 26 is positioned in front or upstream of the catalytic converter 22. Similarly, the downstream oxygen sensor 28 is positioned after or downstream of the catalytic converter 22. It should be appreciated that as part of the emission control system 10, the oxygen sensors 26, 28 are in communication with the engine controller 14.

Figure 2:
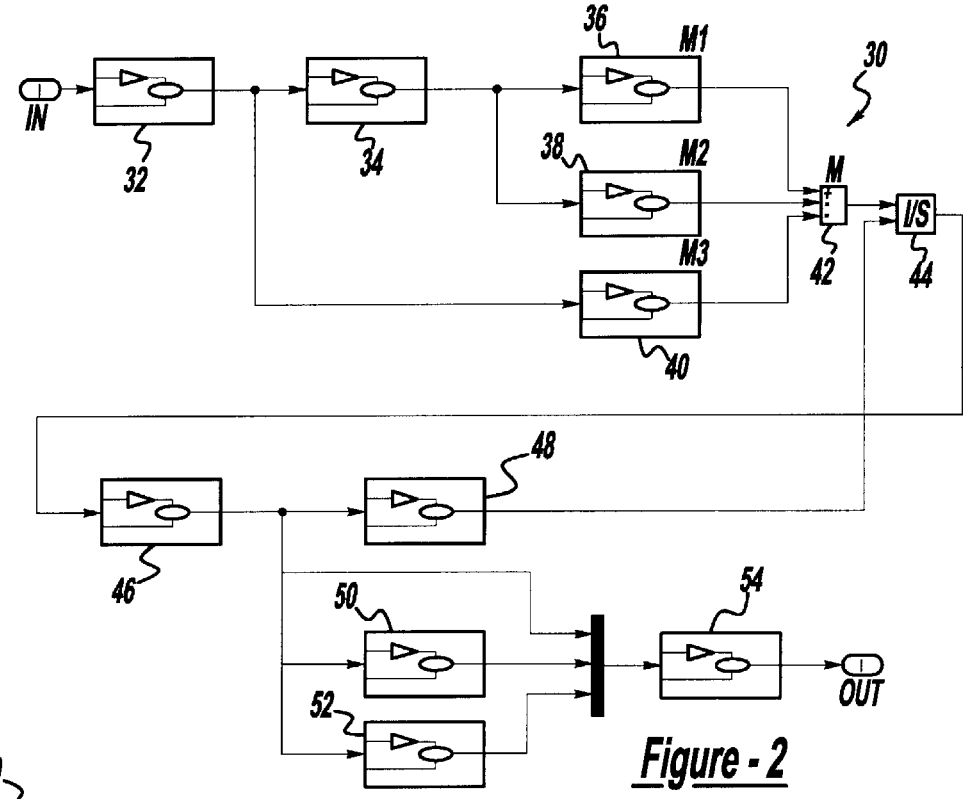
FIG. 2 is an algorithm block diagram illustrating a method according to the present invention for catalytic converter control.

Referring to FIG. 2, an algorithm block diagram 30 illustrating the computational process of the present invention is described. Input module 32 receives conventional control terms such as engine speed, engine load, and λ values from upstream and downstream $O_2$ sensors 26, 28. Input vector 32 distributes upstream λ, downstream λ, fuel composition, and engine operating condition variables to modules 34 and 40 to calculate converter-in and converter-out $O_2$ mass fraction and a predicted $O_2$ consumption mass flow rate respectively. The output of module 34 is then used to calculate converter-in $O_2$ mass flow rate in module 36 and converter-out $O_2$ mass flow rate in module 38. Subtracting the output of modules 38 and 40 from the output of module 36 yields the $O_2$ storage mass flow rate in module 42.

Module 44 represents the integration calculation of the output of module 42, which is provided to module 46 for calculating the net $O_2$ storage amount. Modules 48, 50, and 52 are control algorithms while module 46 provides an extra control term for the fuel control algorithm module 48, On Board Diagnostic (OBD) algorithm module 50, and the fuel cutoff algorithm module 52. The output of module 48 is fed back into the integrator module 44 to adjust fuel control to meet target operation. The control algorithm outputs of modules 46, 50, and 52 are distributed by the output module 54 for incorporation into overall engine control.

The following equations describe the detailed calculations illustrated in FIG. 2:

| | |
|---|---|
| $\dot{m} = \dot{m}_1 - \dot{m}_2 - \dot{m}_3$ | (5) |
| $\dot{m}_1 = v_1 \cdot \dot{m}_4$ | (6) |
| $\dot{m}_2 = v_2 \cdot \dot{m}_4$, | (7) |
| $\dot{m}_3 = f(\lambda_1, \dot{m}_4, T_1, \text{RPM}, \text{MAP}, i)$ | (8) |
| $v_1 = [a_1*(1 + b*y)(\lambda_1 - x)]/[(a_2 + a_3*y) + a_4*(1 + b*y)\lambda_1]$ | (9) |
| $v_2 = [a_1*(1 + b*y)(\lambda_2 - x)]/[(a_2 + a_3*y) + a_4*(1 + b*y)\lambda_2]$ | (10) |
| $x = f(y, \text{RPM}, \text{MAP})$ | (11) |
| y = hydrogen to carbon ratio of the fuel | (12) |
| $O_{2str} = \int m dt = \int (m_i - m_2 - m_3) dt$ | (13) |
| $\text{OSC} = f(\lambda_1, T_1, \text{RPM}, \text{MAP})$ | (14) |

where $\dot{m}$ is the $O_2$ storage mass flow rate; $\dot{m}_1$ is the converter-in $O_2$ mass flow rate; $\dot{m}_2$ is the converter-out $O_2$ mass flow rate; $\dot{m}_3$ is the $O_2$ consumption rate inside the converter; $\dot{m}_4$ is the total exhaust mass flow rate; $v_1$ is the upstream $O_2$ mass fraction;

It should be noted that equation (7) represents the best mode of the invention as practiced by the inventor. The total exhaust mass flow rate at the converter outlet will actually be slightly less than at the converter inlet since a mass flow of oxygen will have been stored within the catalyst. In practice, for the purposes of equation (7) and those dependent upon it, the inventor considers this mass of stored oxygen to be negligible when compared to the total exhaust mass flow rate at the converter outlet.

Referring to equations (9) and (10), $O_2$ mass fraction is modeled. Constants $a_1$, $a_2$, $a_3$, $a_4$, and b are defined as: a1 =molecular weight of $O_2$; $a_2$=atomic weight of carbon; $a_3$ =atomic weight of hydrogen; $a_4$=molecular weight of $O_2$ +($N_2$ to $O_2$ ratio in air)*molecular weight of $N_2$; and b=¼ derived from the stoichiometry of the complete combustion reaction. The complete combustion reaction is:

$$CH_y+(1+y/4)O_2 \rightarrow CO_2+y/2H_2O.$$

Upstream and downstream λ are represented by $\lambda_1$ and $\lambda_2$ respectively. At the optimum stoichiometric point, λ=1.0.

The $O_2$ sensor is designed and calibrated to respond to differing levels of $O_2$ generated during combustion. Using such a sensor, it can be determined whether the air-to-fuel mixture is "rich" (not enough air for the amount of fuel; generally $\lambda<1.0$) or "lean" (excess air for the amount of fuel; generally $\lambda>1.0$).

During operation of a vehicle, an output voltage is based on sensor calibration and the level of $O_2$ detected. One use of the sensor is as an on/off switch. That is, if the output is above some predetermined target voltage, the air-to-fuel mixture is rich and if it is below the target voltage, the mixture is lean. Another use involves processing the actual sensor output through a closed-loop feedback-control system, which compares sensor output to a target value, generates an error, and then develops a correction factor for upcoming combustion cycles. Both applications use $O_2$ sensor output to adjust the amount of fuel used for subsequent combustion cycles, thereby attempting to achieve a stoichiometric air-to-fuel ratio. The conventional way to adjust the amount of fuel is by lengthening or shortening the time pulse of the fuel injectors.

The equations listed above correspond to the modules illustrated in FIG. 2:

Module 32→$\lambda_1$, $\lambda_2$, $\dot{m}_4$, $T_1$, RPM, MAP, i, x, y.

Module 34→equation (9) and (10)

Module 36→equation (6)

Module 38→equation (7)

Module 40→equation (8)

Module 42→equation (5)

Module 44→equation (13).

A preferred embodiment of the present invention includes a method of predicting the instantaneous oxygen storage amount ($O_{2str}$) and the maximum oxygen storage capacity (OSC). With this method, the $O_{2str}$ can be controlled within a calibratable band to maximize the catalyst conversion efficiency with a minimum volume of the converter, thus preventing any transient NOx, CO, and hydrocarbon (HC) breakthroughs. Furthermore, the $O^{2str}$ and OSC may also be used as OBD, and provide smarter fuel cutoff. The present invention also provides cost savings in precious metal loading.

The OSC is determined based on $O^{2str}$ predictions. When downstream $O_2$ breakthrough occurs, an algorithm is triggered to determine whether it is caused by catalyst saturation or by a sharp lean spike. The OSC is updated when the downstream breakthrough is the result of catalyst saturation, which is used to determine when an OBD alarm should be triggered.

Fuel enrichment and lean-out air-to-fuel ratio are triggered based on the estimated $O_{2str}$ to clean up excess oxygen or replenish oxygen so that the amount of oxygen stored can be controlled within the ideal range to prevent $NO_x$, CO, or HC breakthroughs.

The OSC, which can be used to monitor catalyst deterioration, is estimated based on $\lambda_1$, $T_1$, RPM, and MAP. When the maximum OSC is detected to reach the point at which the catalyst conversion efficiency is below a designated threshold, an OBD alarm will be triggered.

Figure 3:
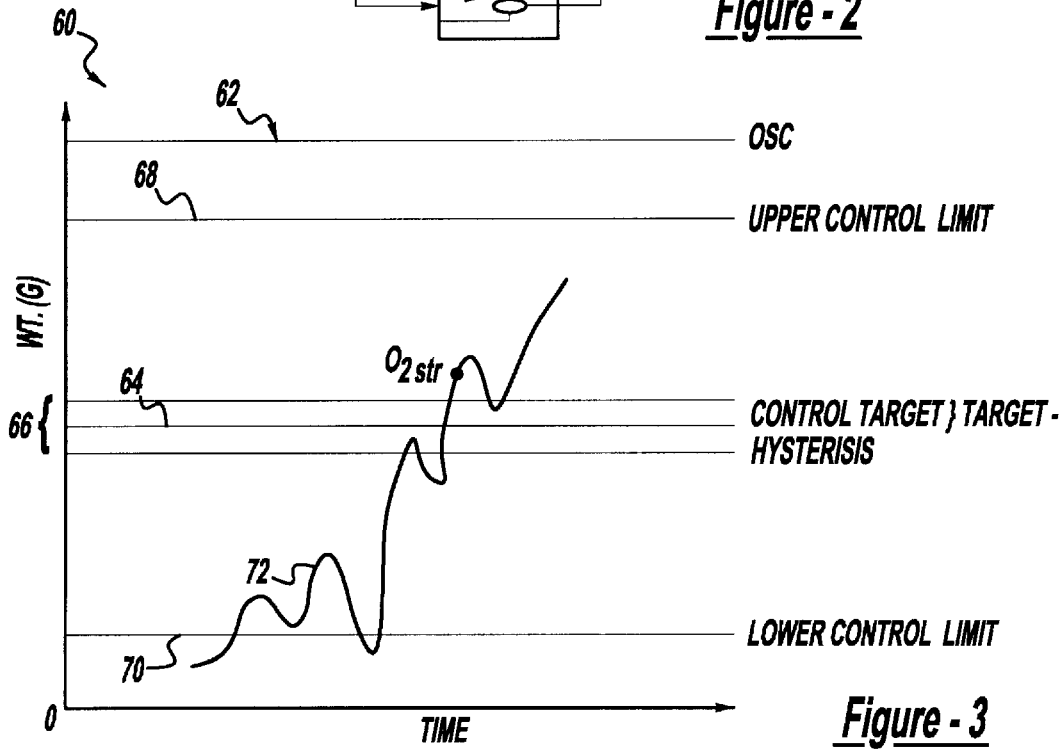
FIG. 3 is a graph representing how instantaneous oxygen storage changes over time within the maximum oxygen storage capacity.

Referring to FIG. 3, a graph 60 representing how $O_{2str}$ without active control changes over time within the OSC is illustrated. Time is measured on the horizontal axis and mass of $O_2$ is measured vertically. Line 62 represents the predicted OSC. The OSC gets smaller over time as the catalyst deteriorates and ages. Target operation 64 is calibrated as a percentage of OSC. Therefore, over time, as the catalyst ages and the OSC decreases, the target value will be adapted, preferably within capacity. Target-hysterisis 66 defines deviation from target amount 64 in which the extra feedback term to the overall engine control is set to zero or is running at optimum condition. Target-hysterisis 66 represents the optimum $O_{2str}$ range during vehicle operation. The control objective is to maintain the $O_{2str}$ within target-hysterisis 66.

Trace line 72 illustrates the path in which $O_{2str}$ changes over time of vehicle operation. When the $O_{2str}$ is above target-hysterisis 66 and below upper control limit 68, the catalyst has too much $O_2$ stored and excess $O_2$ needs to be "cleaned up," i.e., removed. This is accomplished by adding more fuel, commonly known as "enrichment." Alternatively, if the $O_{2str}$ is below target-hysterisis 66 and above lower control limit 70, the catalyst has too little $O_2$ stored and $O_2$ must be replenished in the engine system. This is accomplished by adding more air (which includes $O_2$), commonly known as "lean out." If $O_{2str}$ reaches above upper control limit 68 or below lower control limit 70, the engine control will respond more aggressively through enrichment or lean out. Upon resuming the supply of fuel after deceleration-fuel-cut-off, fuel enrichment will be conducted based on OSC to remove excess. $O_2$, and thus prevent $NO_x$ breakthrough.

Direct measurements of $O_2$ flowing into and out of the converter 22 and the prediction of the $O_2$ consumption rate determine the $O_{2str}$. The method and system according to the invention computes a reasonable amount of chemical reaction data and is implemented for instantaneous on-board control purposes. This method and system may be implemented into any on-board vehicle control unit without incorporating any new hardware or adding new parts to the vehicle. The inventive method and system generally adds an additional feedback control term to existing PID control. More particularly, the total $O_{2str}$ is controlled based on OSC via fueling modifications. Different fueling strategies are used based on the difference between the $O_{2str}$ and the oxygen storage control target. The feature outputs a number of control terms, which will be added to a conventional $O_2$-feedback fuel control.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method of controlling exhaust emissions in a motor vehicle having an engine control system and a catalytic converter, the steps comprising:

sensing an oxygen level upstream of a catalytic converter;

sensing an oxygen level downstream of the catalytic converter;

predicting an oxygen consumption mass flow rate, said oxygen consumption mass flow rate including oxygen consumed, but not stored, within the catalytic converter;

determining an oxygen storage mass flow rate based on said steps of sensing said upstream and downstream oxygen level and said predicted oxygen consumption mass flow rate; and determining an instantaneous oxygen storage amount from said oxygen storage mass flow rate.

2. The method according to claim 1, further comprising the steps of:

calculating an upstream oxygen mass fraction from said sensed upstream oxygen level; and calculating a downstream oxygen mass fraction from said sensed downstream oxygen level;

wherein said calculated upstream and downstream oxygen mass fractions are used to determine said oxygen storage mass flow rate.

3. The method according to claim 2, further comprising the step of calculating a converter-in oxygen mass flow rate and a converter-out oxygen mass flow rate from said upstream oxygen mass fraction and said downstream oxygen mass fraction.

4. The method according to claim 3, wherein said step of determining an oxygen storage mass flow rate is determined from said converter-in oxygen mass flow rate, converter-out oxygen mass flow rate, and said predicted oxygen consumption mass flow rate.

5. The method according to claim 3, further comprising the step of determining an upstream lambda by determining an upstream oxygen flow rate from said step of sensing an oxygen level upstream of the catalytic converter.

6. The method according to claim 5, further comprising the step of determining a downstream lambda by determining a downstream oxygen flow rate from said step of sensing an oxygen level downstream of the catalytic converter.

7. The method according to claim 6, wherein said step of determining said upstream oxygen mass fraction uses said upstream lambda, a set of reaction constants, and a reaction fraction.

8. The method according to claim 7, wherein said step of determining said downstream oxygen mass fraction is achieved by using said downstream lambda, a set of reaction constants, and a reaction fraction.

9. An engine control system for a motor vehicle having an engine with an exhaust coupled to a catalytic converter, the control system comprising:

an upstream oxygen sensor disposed upstream from the catalytic converter;

a downstream oxygen sensor disposed downstream from the catalytic converter;

an engine controller monitoring engine operating parameters, monitoring output signals of said upstream and downstream oxygen sensors, determining an amount of oxygen consumed within the catalytic converter upstream of said downstream oxygen sensor, determining an amount of oxygen stored in the catalytic converter based on said monitored sensor output signals and said amount of oxygen consumed, and controlling engine operation to maintain said oxygen storage amount within an oxygen storage capacity of the catalytic converter.

10. The engine control system of claim 9, wherein said engine controller further includes a target oxygen storage amount selected within a range from zero oxygen storage capacity to about said oxygen storage capacity, and said engine controller controlling engine operation to maintain said amount of oxygen stored in the catalytic converter at approximately said target oxygen storage amount.

11. The engine control system of claim 10, wherein a plurality of fuel injectors receive a control signal from said engine controller to supply fuel to the engine at a rate where said oxygen storage amount is approximately said target oxygen storage amount.

12. A method of controlling exhaust emissions from a catalytic converter connected to the exhaust of a motor vehicle engine, the steps comprising:

sensing an oxygen level upstream of the catalytic converter, sensing an oxygen level downstream of the catalytic converter;

predicting an oxygen consumption mass flow rate;

determining an oxygen storage mass flow rate based on said steps of sensing said upstream and downstream oxygen levels and said predicted oxygen consumption mass flow rate;

determining an instantaneous oxygen storage amount from oxygen storage mass flow rate;

determining a maximum oxygen storage capacity;

selecting a target percentage of said maximum oxygen storage amount; and controlling the motor vehicle engine performance to a state where said predicted instantaneous oxygen storage amount is approximately said target percentage of said maximum oxygen storage amount.

13. The method according to claim 12, further comprising the step of determining an upstream oxygen flow rate from said step of sensing an oxygen level upstream of the catalytic converter.

14. The method according to claim 12, further comprising the step of determining a downstream oxygen flow rate from said step of sensing an oxygen level downstream of the catalytic converter.

15. The method according to claim 12, further comprising the steps of:

calculating an upstream oxygen mass fraction from said sensed upstream oxygen level; and calculating a downstream oxygen mass fraction from said sensed downstream oxygen level;

wherein said calculated upstream and downstream oxygen mass fractions are used to determine said oxygen storage mass flow rate.

16. The method according to claim 15, wherein said step of determining said upstream oxygen mass fraction further comprises using a set of reaction constants, a reaction fraction, and a determined upstream lambda.

17. The method according to claim 15, wherein said step of determining said downstream oxygen mass fraction further comprises using a set of reaction constants, a reaction fraction, and a determined downstream lambda.

18. The method according to claim 15, further comprising the step of calculating a converter-in oxygen mass flow rate and a converter-out oxygen mass flow rate from said upstream oxygen mass fraction and said downstream oxygen mass fraction.

19. The method according to claim 18, wherein said step of determining an oxygen storage mass flow rate is determined from said converter-in oxygen mass flow rate, converter-out oxygen mass flow rate, and said predicted oxygen consumption mass flow rate.

* * * * *